United States Patent [19]

King et al.

[11] 4,124,070

[45] Nov. 7, 1978

[54] WIRELINE SHIFTING TOOL APPARATUS AND METHODS

[75] Inventors: David W. King; Robert K. Pipes, both of Fort Worth, Tex.

[73] Assignee: Gearhart-Owen Industries, Inc., Fort Worth, Tex.

[21] Appl. No.: 830,390

[22] Filed: Sep. 6, 1977

[51] Int. Cl.[2] ..... E21B 43/12

[52] U.S. Cl. ..... 166/255; 166/65 R; 166/315; 166/332

[58] Field of Search ..... 166/255, 65 R, 332, 166/315

[56] References Cited

U.S. PATENT DOCUMENTS

| | | | |
|---|---|---|---|
| 2,380,022 | 7/1945 | Bart | 166/332 |
| 2,667,926 | 2/1954 | Alexander | 166/332 |
| 2,924,278 | 2/1960 | Garrett et al. | 166/332 |
| 3,073,392 | 1/1963 | Dinning et al. | 166/332 |
| 3,353,607 | 11/1967 | Kinley | 166/332 |

*Primary Examiner*—Ernest R. Purser
*Attorney, Agent, or Firm*—Wm. T. Wofford

[57] ABSTRACT

An improved wireline borehole shifting tool comprises upwardly extending upper dog means and downwardly extending lower dog means, with the upper dog means being extendable and retractable responsive to slack or tension, respectively, in the wireline; with the lower dog means being extendable and retractible and longitudinally movable relative to the upper dog means responsive to movement of a reciprocator shaft and power means that is disposed within the tool body beneath the lower dog means and with the lower dog means being at all times movable radially inwardly against a spring bias force. Also disclosed is an arrangement utilizing the shifting tool for running a caliper log of the borehole conduit diameter profile for a selected region, with the shifting tool lower dog means acting as the caliper sensing means. Further disclosed are unique methods for utilizing the shifting tool to perform shifting operations on devices that are disposed in wellbore conduits. Additionally disclosed are unique methods utilizing the shifting tool to initiate shifting movement in such devices.

15 Claims, 11 Drawing Figures

Fig. 1
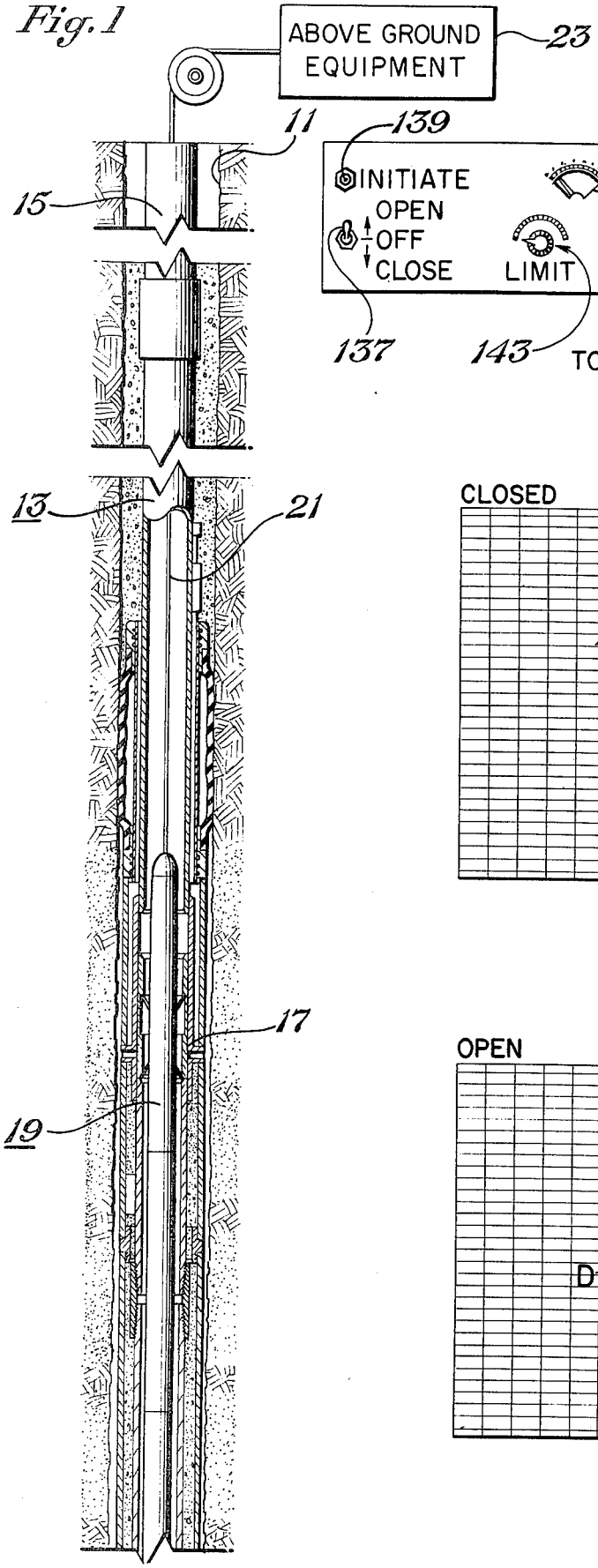
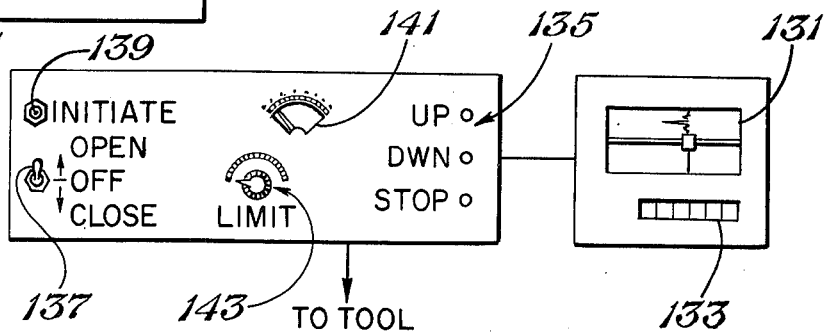
Fig. 6
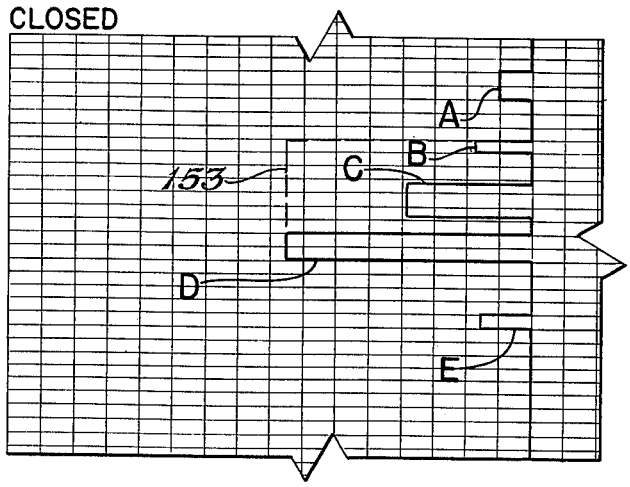
Fig. 7
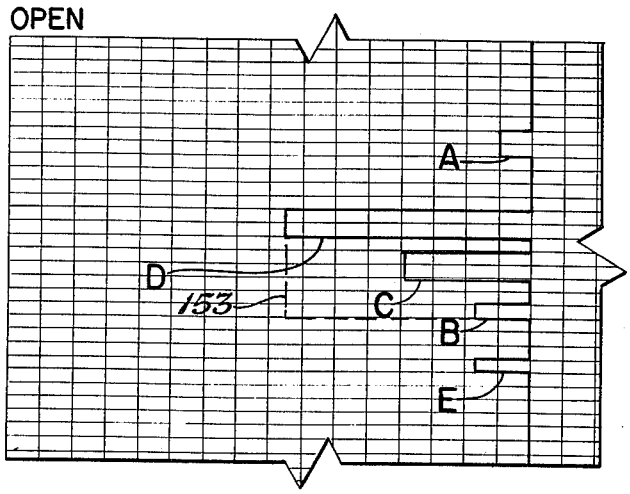
Fig. 8

WIRELINE SHIFTING TOOL APPARATUS AND METHODS

FIELD OF THE INVENTION

This invention relates to apparatus and methods for accomplishing relative axial movement of a device or a part of a device that is disposed in an earth borehole. The invention is particularly applicable to wireline shifting tools and to the shifting of sleeve valve devices.

BACKGROUND OF THE INVENTION

It is necessary in some operations to accomplish relative axial movement of a device or a part of a device that is disposed in an earth borehole. One type of apparatus utilized for this purose is a shifting tool that is run into a borehole on a wireline. Such a wireline shifting tool in accordance with the prior art has utilized extendable and retractable upwardly facing upper dogs and downwardly facing lower dogs, with various means for extending and retracting the dogs. One set of dogs engages the part to be shifted and the other engages a member fixed relative to the part to be shifted. Power is then applied to move the dogs further apart and consequently shift the part to be shifted.

A serious difficulty has been experienced in such prior art apparatus due to inability to retract the dogs and retrieve the shifting tool from the borehole in the event of a malfunction. The problem is especially acute when upwardly facing dogs can not be retracted. Problems have also been encountered in prior art apparatus in connection with the proper positioning of the tool relative to the device to be shifted.

It is accordingly the general object of this invention to provide improved wireline shifting tool apparatus and methods that obviate the difficulties and problems above mentioned.

For a further understanding of the invention and further objects, features, and advantages thereof, reference may now be had to the following description, taken in conjunction with the accompanying drawings.

BRIEF DESCRIPTION OF THE DRAWINGS

FIG. 1 is a general view, schematically showing apparatus of the invention in place in a borehole to accomplish a sleeve valve shifting operation.

FIG. 6 is a schematic showing of some of the above ground equipment that is employed in the operation of the tool.

FIGS. 7 and 8 are portions of caliper logs showing conduit diameter profiles in the vicinity of a sleeve valve.

DESCRIPTION OF PREFERRED EMBODIMENTS

Figure 2A:
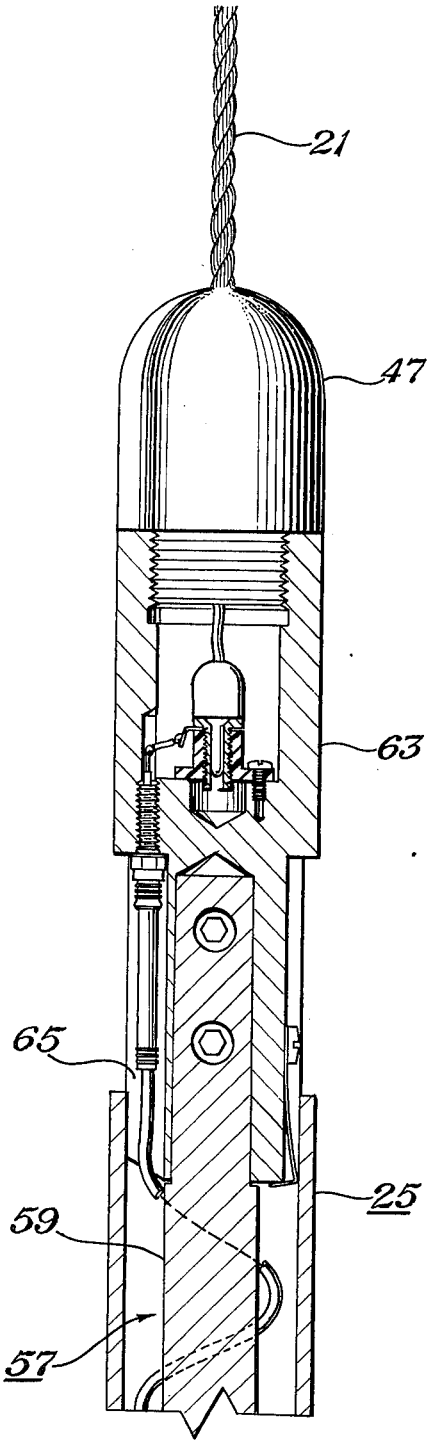
FIGS. 2A, 2B, 3A and 3B are schematic partial longitudinal section views showing (when placed end to end) a wireline shifting tool in accordance with a preferred embodiment of the invention; with the tool being shown in the "running in" state.

Referring now to the drawings, in FIG. 1 there is shown a typical well or borehole 11 in which an isolation tool 13 has been connected into a conventional tubular string of conduit such as casing 15. The isolation tool 13 may be of the type disclosed in U.S. Pat. No. 3,865,188, which incorporates one or more sleeve valves 17. A shifting tool 19, in accordance with a preferred embodiment of the invention, has been run into the well 11 on a wireline 21 and positioned to shift the sleeve valve 17 to its open state. The wireline 21 and the shifting tool 19 are operated and controlled by above ground equipment, shown as a block 23.

The shifting tool 19, as shown by FIGS. 2A, 2B, 3A, 3B, may be considered as made up of three sections or "subs", which for convenience are referred to as the upper sub 25, the middle sub 27 and the lower sub 29. The upper sub 25 carries upper dog means 31; the middle sub 27 carries lower dog means 33; and the lower sub 29 carries power means 35 for operating the lower dog means 33. The upper sub 25 has a body portion 37 which is removably secured at its lower end by conventional means such as cap screws 39 to the upper end of a body portion 41 of the middle sub 27, which in turn is removably secured at its lower end by conventional means such as cap screws 39 and a mounting sub 43 to the upper end of a body portion 45 of the lower sub 29. The shifting tool 19 is attached at its upper end by means of a conventional cable head 47 to the wireline 21. The lower end of the shifting tool is closed by a conventional bottom sub 49 to which additional apparatus may be attached.

The upper dog means 31 comprises a set of upper links 51 and a set of lower links 53. Each upper link 51 is pivotally connected at its upper end at 55 to the lower end of an upper reciprocator shaft means 57. The upper reciprocator shaft means comprises a shaft 59 which carries at its lower end a guide means 61 which is slidable on the inner wall of the upper sub body portion 37. The shaft 59 is removably attached to a top sub 63 a lower portion 65 of which is slidably received in mating relation by the inner wall of the upper sub body portion 37.

Figure 2B:
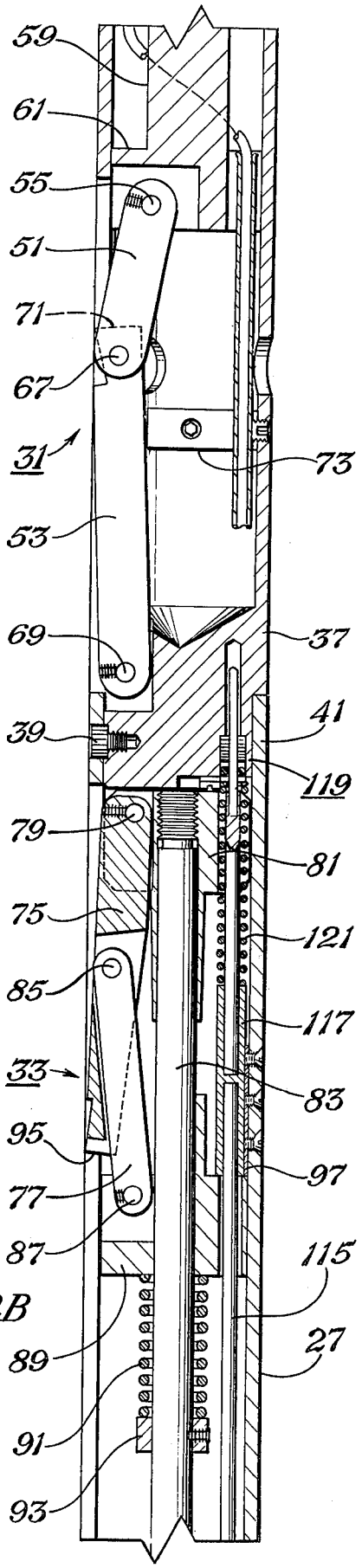
Figure 5A:
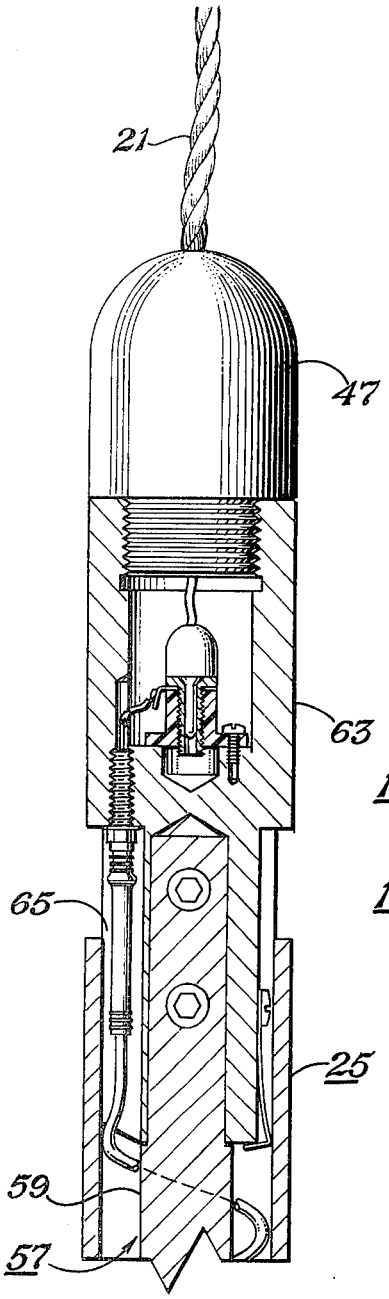
FIG. 5A is like FIG. 2A except that the wireline is slack and the upper reciprocator shaft means has moved downwardly to extend the upper dog means.
Figure 5B:
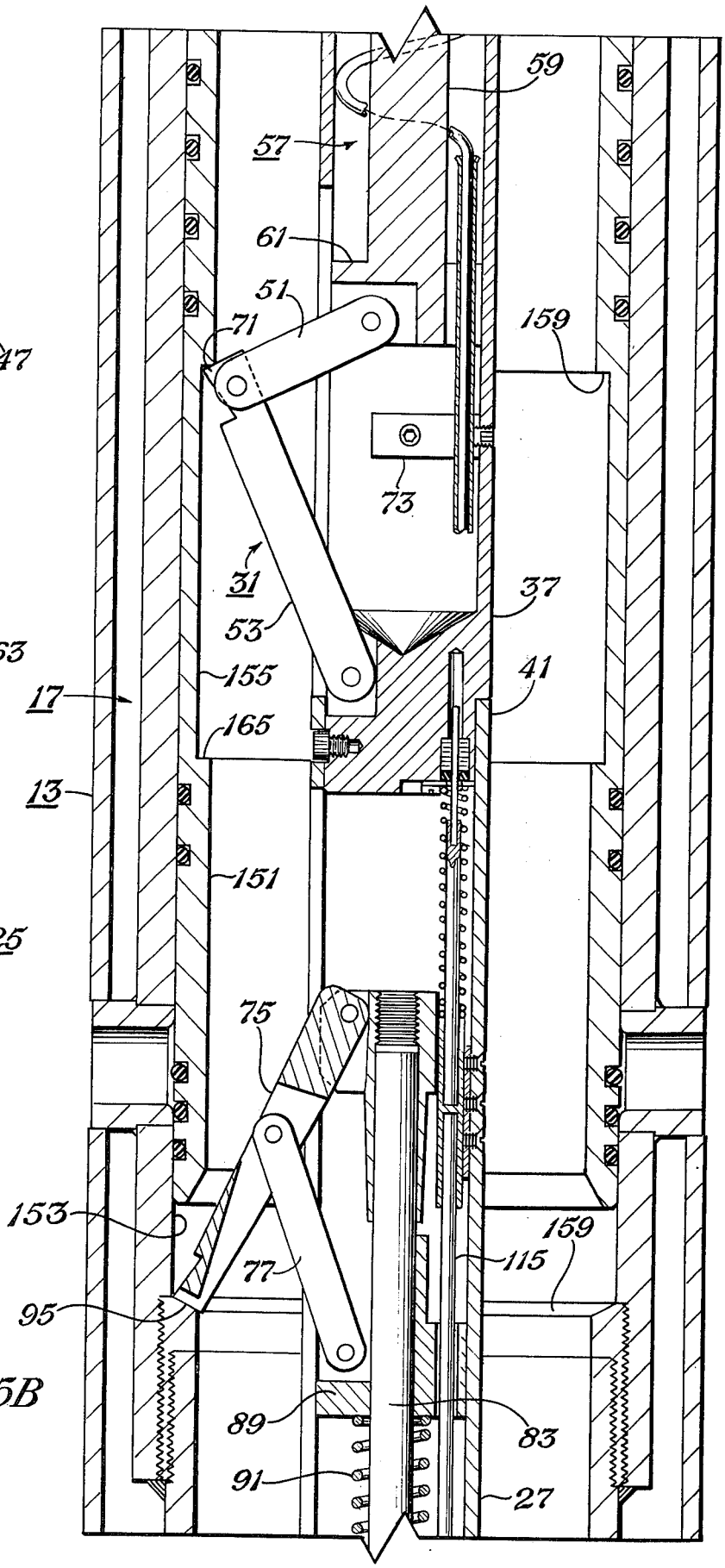
FIG. 5B is like FIG. 2B except that the upper and lower dog means are intended and the tool has begun to shift a sleeve valve toward its opened position.

Each upper link 51 is pivotally connected at its lower end at 67 to the upper end portion of a respective lower link 53 which is pivotally connected at its lower end at 69 to the upper sub body portion 37. The upper end portion of each lower link 53 is provided an upwardly facing work engaging portion 71. When tension is applied on the wireline 21, the upper travel of the top sub 63 is limited by the extended length of the links 51, 53 which are then in the retracted position, as shown in FIG. 2B. When the wireline 21 is slack, the top sub 63 is moved downwardly by the force of gravity, causing the shaft 59 to push the links 51, 53 to their extended position, as shown in FIG. 5B. Downward movement of the shaft 59 is limited by a stop 73 which is fixed to the upper sub body portion 37.

The lower dog means 33 comprises a set of upper links 75 and a set of lower links 77. Each upper link 75 is pivotally connected at its upper end at 79 to a guide block 81 which is slidable in mating relation on the inner wall of the middle sub body portion 41. The guide block 81 is removably fixed to a drive shaft 83. The guide block 81 and drive shaft 83 may be considered as parts of lower reciprocator shaft means 99. Each upper link 75 is pivotally connected intermediate its ends at 85 with the upper end of a respective lower link 77. The lower end of each lower link 77 is pivotally connected at 87 to a slidable collar 89 which is disposed on said drive shaft 83 and received in mating relation by the inner wall of the middle sub body portion 41. A compression spring 91 bears at one end on a retainer 93 that is fixed to the drive shaft 83 and at the other end on said slidable collar 89, such that said slidable collar is at all times being urged upwardly. The lower end of each upper link 75 protrudes beyond the pivot connection 85 of the respective links 75, 77 and is provided a downwardly facing work engaging portion 95 at its lower end.

Upward movement of the slidable collar 89 is limited by a stop 97 so that when the drive shaft 83 is at the upper limit of its travel, the links 75, 77 are in their retracted position, as shown in FIG. 2B. As the drive shaft 83 is moved downwardly from the position shown in FIG. 2B, the slidable collar 89 is held by the compression spring 91 against the stop 97, so that the upper link upper pivot 79 moves toward the lower link lower pivot 87, causing the links 75, 77 to move toward their extended position.

The lower sub 29 carries the power means for the lower reciprocator shaft means 99. The power means comprises an electric motor 101 which is controlled from the above ground equipment 23. The electric motor 101, through reduction gearing 103, rotates a drive screw 105. The drive screw 105 is supported at its lower end by suitable bearing means 107 and engages an internally threaded drive sleeve 109 which is reciprocable within a drive cylinder 111. The drive sleeve 109 is connected to the drive shaft 83 by means of a drive tube 113 that is threaded connected at its lower end to the drive sleeve 109 and at its upper end to the drive shaft 83. The bore of the drive shaft 113 accommodates the drive screw 105 when it projects within the drive tube 113.

Figure 3A:
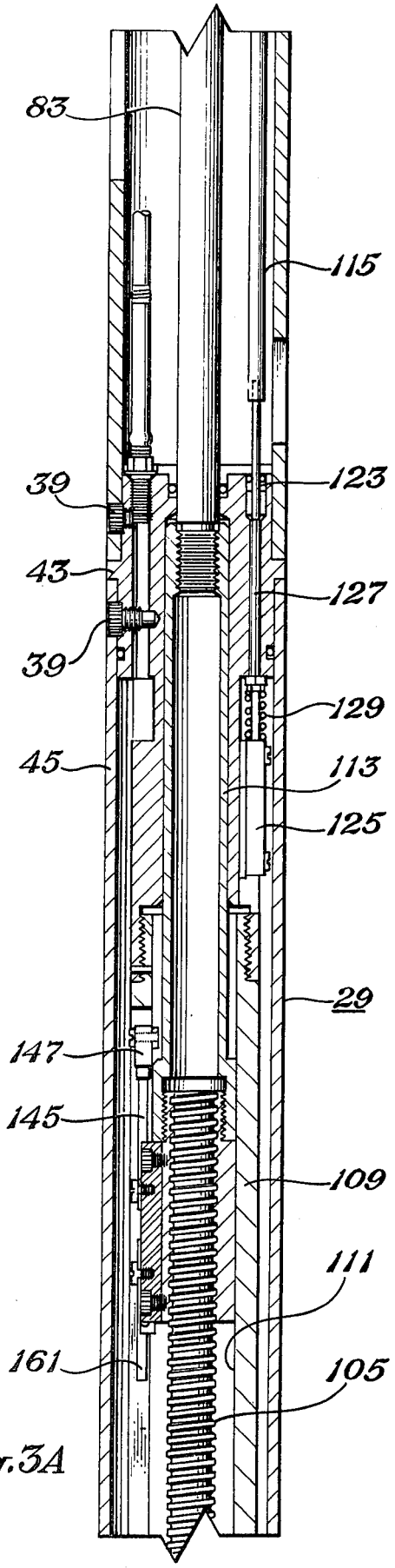
Figure 3B:
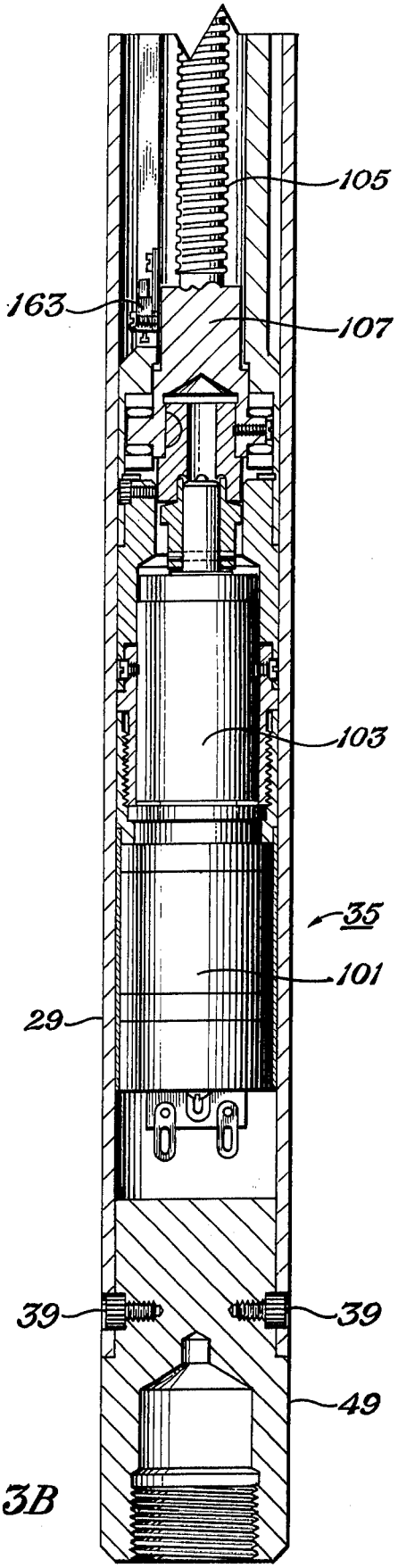
Figure 4:
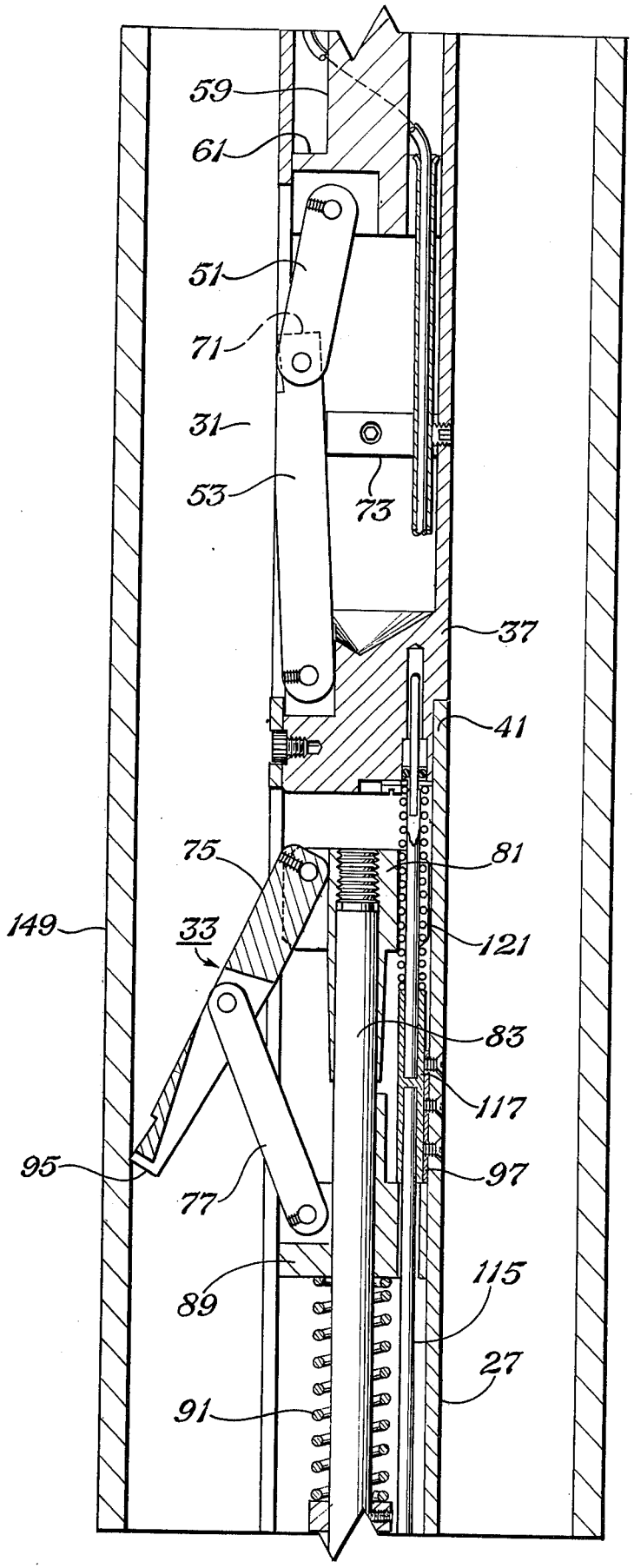
FIG. 4 is like FIG. 2B except that the lower dogs have been extended to the caliper position within a section of borehold conduit.

In operation of the shifting tool, it is desirable to utilize caliper means for generating electrical signals which are a function of the diameter profile of the conduit that may be traversed by said shifting tool 19. It is also desirable that the lower dog means 33 be utilized as a sensor means for said caliper means. As shown by FIGS. 2B and 3A, the caliper means comprises a push rod 115, a push rod sleeve 117, an upper push rod guide and seal means 119, an upper compression spring 121, a lower push rod guide and seal means 123, a potentiometer 125, a potentiometer piston 127 and a lower compression spring 129. The upper push rod guide and seal means 119 is carried by the upper sub body portion 37. The push rod sleeve 117 receives upper and lower portions of the push rod 115 and prevents their relative movement. The upper compression spring 121 surrounds an upper portion of the push rod 115 and bears at its upper end on said upper push rod guide and seal means 119 and at its lower end on the upper end of said push rod sleeve 117, thus urging the push rod sleeve in the downward direction. The lower end of the push rod sleeve 117 bears on the slidable collar 89 when the shifting tool is in the "running in" position, as shown by FIG. 2B and also when the shifting tool 19 is in the calipering position, as shown by FIG. 4. The push rod sleeve 117, and consequently the push rod 115 will follow limited movement of the slidable collar during a calipering operation, as will be hereinafter more fully explained. The lower extremity of the push rod 115 bears on the upper extremity of the potentiometer piston 127, the latter being biased upwardly by the lower compression spring 129. Thus, the potentiometer piston 127 will follow movement of the push rods 115, causing corresponding movement of the wiper contact (not shown) of potentiometer 125.

The above ground equipment 23 may be generally of a conventional type utilized for suspending, traversing, and controlling a wireline tool in a borehole and, consequently, is not shown or explained in detail, with the exception of portions shown by FIG. 6 which are particularly applicable to the apparatus and methods of the present invention. In FIG. 6 there is shown a portion of the above ground equipment, including a strip chart recorder 131 and a depth register 133 connected to a portion of an operator's console which in turn is connected to the shifting tool 19 via the wireline 21. The console portion includes a set of push button switches 135 to control the traverse of the shifting tool 19 in the borehole; a double-throw toggle switch 137 to control the electric motor 101 of the shifting tool power means 35; a push button 139 to permit re-starting of the electric motor 101 after it has been stopped by the actuation of a limit switch, as will be hereinafter more fully explained; a current meter 141 to indicate the load current of the electric motor; and a control knob and indicator 143 for setting predetermined load current limits for the electric motor 101, as will be hereinafter more fully explained.

Electrical connection from the above ground equipment 23 to the shifting tool 19 is made via the wireline 21 through the cable head 47 and conventional plug means. The necessary electrical connections within the shifting tool 19 may be made in conventional manner and, consequently, are not shown and explained in detail herein.

A typical operation for the shifting tool 19 is to shift (open or close) a sleeve valve 17 in an isolation tool 13 such as that shown in FIG. 1 and disclosed in U.S. Pat. No. 3,865,188, hereinabove mentioned. To perform such operation, the shifting tool 19 (being in its "running in" state, as shown by FIGS. 2A, 2B, 3A, 3B) is lowered into the borehole 11 to a depth, as indicated by the depth register 133, known by the operator to be beneath the isolation tool 13. Then, the electric motor 101 is energized by moving the toggle switch 137 to the "open" position, which causes the electric motor 101 to run in the direction to move the drive shaft 83 downwardly. The drive shaft will continue shut downward movement until a limit switch actuator carried by the drive sleeve 109 encounters and opens a caliper position limit switch which causes the electric motor 101 to stop. The drive shaft 83 can move downwardly a certain distance before the slidable collar 89 leaves its stop 97; the slidable collar being held against the stop by the compression spring 91. Thus, during initial downward movement of the drive shaft 83, links 75 of the lower dog means 33 move toward their extended position, but will not be extended beyond the calipering position because of the aforementioned limit switch action. The calipering position of the links 75 is arbitrarily preset to define a diameter that is the maximum diameter normally encountered in the well conduit in the vicinity of such an isolating tool. Any movement of the links 75 in the radially inward direction (since the guide block 81 does not move when the electric motor 101 is stopped) will cause downward movement of the slidable collar 89 against the force of the compression spring 91. Thus, as calipering action takes place, the slidable collar 89 will move downwardly and upwardly accordingly. The movement of the slidable collar 89 will be followed by the push rod 115 as hereinbefore explained, causing corresponding movement of the wiper contact of the potentiometer 125, and, consequently, generating an electric signal which is a function of the calipering movement of the links 75. FIG. 4 shows the shifting tool 19 in the calipering position or state within a section of conduit 149 beneath the isolation tool 13.

Next, the shifting tool 19 is traversed upwardly while the calipering signal is transmitted via the wireline 21 to the strip chart recorder 131 to make a log of the diameter profile of the conduit portion traversed. Representative logs or traces of a conduit diameter profile in the immediate vicinity of a sleeve valve 17 is shown by FIGS. 7 and 8. For further clarity, the sleeve valve cylinder portion 153 is represented by the dashed lines shown in FIGS. 7 & 8.

The characteristic features of the diameter profile log of a sleeve valve make it readily recognizable by an operator. Referring to FIGS. 7 and 8, it being remembered that the profile depth decreases from the top to the bottom of the traces, excursion A represents the juncture of the bottom of the sleeve valve 17 with the conduit or casing 149; excursion B represents the juncture of the sleeve portion 151 of the sleeve valve 17 with the cylinder portion 153 (see FIG. 5B); excursion C represents the enlarged diameter portion 155 of the sleeve portion 151; excursion D represents the cylinder portion 153 that is exposed above or below the sleeve portion 151 when the sleeve valve 17 is fully opened or fully closed; the excursion E represents the juncture of the top of the sleeve valve 17 with the conduit or casing 149. If it is assumed that the sleeve valve 17 is closed, then the log trace that has just been made will look like that of FIG. 7.

When the operator sees that he has made a complete calipering traverse of the sleeve valve 17 that he wishes to manipulate, the traversing is stopped by pushing the STOP button of the switch set 135 and the lower dog means 33 is closed by moving toggle switch 137 to the CLOSE position and then pressing the INITIATE buttom 139 which effects bypassing of the open contact of the calipering position limit switch permitting the electric motor 101 to be energized. The electric motor will run until a limit switch actuator 145 carried by the drive sleeve 109 encounters and opens a drive shaft upper limit switch 147 (see FIG. 3A), at which time the lower dog means 33 will have moved to its closed position. After the lower dog means 33 is closed, the shifting tool 19 is traversed downwardly (initiated by pushing the DWN button of the switch set 135) to a position that is below the sleeve valve 17 as determined by observation of the depth register 132 and stopped (by pushing the STOP button of the switch set 135).

Next, the lower dog means 33 is again moved to the calipering position and the shifting tool 19 is again traversed upwardly (initiated by pushing the UP button of the switch set 135), again making a log of the conduit diameter profile, which log is carefully observed by the operator as it is being made. Presently, excursion A (of FIG. 7) will be repeated, telling the operator that the work engaging portions 95 of the links 75 of the lower dog means 33 are at that moment located at the juncture of the bottom of the sleeve valve 17 with the conduit or casing 149. The traversing continues with the operator watching closely for the repetition of excursion B which will presently appear, and when it does, he immediately stops the traverse. The operator knows that the work engaging portions 95 of the links 75 of the lower dog means 33 are now located immediately above the juncture of the sleeve portion 151 of the sleeve valve 17 with the cylinder portion 153. Further, the operator knows, from the log made by his first traverse, that the sleeve valve 17 is closed, because the log shows that excursion C was encountered before excursion D (see FIG. 7), If excursion D were encountered before excursion C (as in FIG. 8), this would indicate that the sleeve valve 17 is in the OPEN position.

Next, the operator briefly pushes the DWN (down) button and then the STOP button of the switch set 135 to cause the top sub 63 to be moved downwardly by the force of gravity, causing the shaft 59 to push the links 51, 53 of the upper dog means 31 to their extended position.

Next, with the toggle switch 137 in the OPEN position, the INITIATE button 139 is pushed, causing energization of the electric motor 101 to move the drive shaft 83 in the downward direction, which should cause the work engaging portions 95 of the links 75 to seat on the lower lip or shoulder 157 forming the bottom extremity of the cylinder portion 153 of the sleeve valve 17, as shown in FIG. 5B; after which further downward movement of the drive shaft 83 should cause the work engaging portions 71 of the links 53 of the upper dog means 31 to move upwardly to engage the shoulder 159 formed by the lower extremity of the enlarged diameter portion 155 of the sleeve portion 151, as shown in FIG. 5B. If the two events last mentioned have occurred, the operator will observe (on meter 191) a rise in the load current of the electric motor 101, and will know that the shifting tool 19 is now properly positioned so that the opening of the sleeve valve 17 can be accomplished.

The operator should, at this time, be sure that the motor current limit control 143 is properly set. For discussion purposes, assume that the electric motor 101 is a direct current motor operating at 250 volts applied above ground less line drops and is capable through its gear reduction 103 and drive screw 105 of applying a maximum of 10,000 pounds pull on the drive shaft 83. Also, assume that the sleeve valve 17 is designed so as to require about 5,000 pounds of pulling force to initiate its movement under normal conditions. It should be noted that the sleeve valve 17 incorporates several O-ring seals (11 for the embodiment shown in FIG. 5B). The force required to maintain sleeve valve movement will usually be in the range of 50 to 70 percent of the force required to initiate movement. The sleeve valve becomes a static load within a few seconds after its motion is stopped and within a few minutes will have returned to the state wherein the normal force required to initiate movement will be required to again initiate movement. Unfortunately, the conditions encountered in shifting a sleeve valve are often not normal. Such abnormal conditions often encountered include cement buildup or debris within the sleeve valve, corrosion, or deformation, which abnormal conditions either singly or in combination make initial movement of the sleeve portion 151 quite difficult. In numerous cases it has been found that the force required to initiate movement of the sleeve portion 151 of a particular sleeve valve 17 exceeded the pulling capacity of the shifting tool 19 and the shifting effort simply had to be abandoned. It has been discovered, however, that if a particular procedure is followed, the shifting tool 19 can be made to initiate movement of the sleeve portion 151 in almost all cases, and certainly in many cases where the initiation of the sleeve portion movement would otherwise be beyond the capacity of the shifting tool 19. This particular procedure is advantageous to use in all cases, because it significantly reduces the level of demands on the electric motor 101 and associated electrical components.

In accordance with the particular procedure, above mentioned, the operator, after the second calipering traverse is stopped, sets the motor load current limit control 143 for a drive shaft pull of about 6,000 pounds and, assuming that the shifting tool 19 is properly positioned as hereinabove mentioned, the electric motor 101 runs until the preset load current limit is reached, at which time the motor voltage is removed, stopping the motor. The friction of the gear reduction 103 and the drive screw 105 act as a brake to prevent rotational movement of the drive screw 105 when the motor 101 is stopped. Consequently, the 6,000 pound pull on the drive shaft 83 continues, and is allowed to continue for a short period of time, typically in the range of about 20 seconds to one minute. Then, the motor 101 is run briefly in the direction to move the drive shaft 83 upwardly, to remove the pull load and back the drive up enough that the motor 101 and its gear reduction 103 and drive screw 105 can "run" into the next pull load. Then, the motor 101 is again energized in the direction to move the drive shaft 83 downwardly to pick up another pull load. It is preferable that the motor load current limit be set at a higher value, for example 7,000 pounds, for the second pull effort. If the first pull effort is sufficient to initiate movement of the sleeve portion 151, then the load current does not reach its preset maximum (corresponding to 6,000 pounds pull) and levels off at the pull required to keep the sleeve portion 151 moving, in which case the movement continues until a limit switch actuator 161, carried by the drive sleeve 109, encounters and opens a drive shaft lower limit switch 163, at which time the sleeve portion 151 has been moved to the sleeve valve 17 full open position.

If the first pull effort is not sufficient to initiate movement of the sleeve valve portion 151, then such movement may begin during the second pull effort, in which case the motor load current does not reach the preset maximum (corresponding to a 7,000 pound pull) but levels off at the pull requuired to keep the sleeve portion 151 moving and the sleeve portion is moved to the sleeve valve 17 full open position in the same manner as was above described.

If the second pull effort is not sufficient to initiate movement of the sleeve portion 151, then the electric motor 101 continues to run until the preset load current limit is reached, at which time the motor voltage is removed, stopping the motor. The pull on the drive shaft 83 (7,000 pounds) is allowed to continue for a short period of time, as before, and then the motor 101 and its gear reduction 103 and its drive screw 105 are backed off; the current limit control is preferably set at a higher value, for example, 8,000 pounds, for the third pull, and the procedure is repeated until sleeve portion 151 movement is initiated.

When the sleeve valve 17 reaches the full open position, as above described, the motor 101 will be stopped by the drive shaft lower limit switch 163, which event is apparent to the operator because the motor load current drops to zero.

Next, the motor 101 is energized in the direction to move the drive shaft 83 upwardly (by placing the toggle switch 137 in the CLOSE position and pushing the INITIATE button 139) and the motor 101 will continue to run until the drive shaft upper limit switch 145 is opened, at which time the lower dog means 33 will be fully retracted.

Next, the UP button of switch set 135 is pushed and the wireline 21 begins upward movement. When the slack is removed from the wireline 21, an upward pull will be exerted on the top sub 63, causing the upper reciprocator shaft means 57 to move upwardly, retracting the upper dog means 31 and then beginning movement of the shifting tool 19 upwardly in the borehole 11. At this point, if desired, another caliper log can be run to verify that the sleeve valve 17 is now in the open position. The shifting tool 19 may now be withdrawn from the borehole 11.

If the sleeve valve 17 is in the open position, then the first calipering log run would be like that of FIG. 8. If it is desired to close the sleeve valve 17, then a second calipering log would be run and the operator would stop the traverse when the beginning of excursion C appears. The operator knows that the work engaging portions 95 of the links 77 of the lower dog means 33 are now located immediately above the shoulder 165 formed by the lower extremity of the enlarged diameter portion 155 of the sleeve portion 151 (FIG. 5B). Next, the operator extends the upper dog means 31 and energizes the motor 101 to properly position the shifting tool 19 so that the closing of the sleeve valve 17 can be accomplished, which is all done in the manner previously described for the sleeve valve opening operation. The procedure to be followed to initiate closing movement of the sleeve portion 151 and for then closing the sleeve valve 17 is the same as previously described for the opening operation. The primary difference in a sleeve valve closing operation and a sleeve valve opening operation is in the positioning of the upper and lower dog means 31, 33. The shifting tool 19 is properly positioned for a closing operation when the work engaging portions 95 of the lower dog means 33 are seated on the lower shoulder 165 of the enlarged diameter portion 155 and the work engaging portions 71 of the upper dog means 31 are seated on the lip or shoulder formed by the upper extremity of the sleeve valve cylinder portion 153.

The shifting tool of the present invention is particularly advantageous from the "fail safe" standpoint. In the event that for any reason it becomes impossible to move the drive shaft 83, the shifting tool 19 can be readily moved from the borehole 11, regardless of the position of the drive shaft 83 and the consequent position of the lower dog means 33. The upper dog means 31 can always be retracted by simply applying tension to the wireline 21. The links 75 of the lower dog means are always moveable in the radially inward direction because the slideable collar 89 is always moveable downwardly against the force of compression spring 91. Thus, the shifting tool 19 can always be readily moved from the borehole 11 by simply applying tension on the wireline 21 and traversing the shifting tool upwardly out of the borehole.

The steps in carrying out the method of the invention for shifting a device in a wellbore conduit, which device is subject to difficulty in initiating its shifting movement, may be stated as follows:

a. applying a first shifting force to said device to be shifted, which first shifting force is at least as great as that which would normally be required to initiate shifting movement of said device and maintaining said first force for a short time period and then removing it;

b. then applying a second shifting force to said device which second shifting force is greater than the first shifting force and maintaining said second force for a short time period and then removing it;

c. then, if movement is not initiated, applying a third shifting force greater than the second and maintaining it for a short period of time and then removing it;

d. then, if movement is not initiated, applying, maintaining, and removing additional shifting forces until either movement is initiated or the shifting tool maximum force capacity is reached.

In a more specific embodiment, the steps of the immediately preceding method may be carried out as further defined as follows:

a. said shifting forces are applied by an electric motor incorporated in a shifting tool and powering a reciprocable drive shaft through a gear reduction and a drive screw;

b. above ground equipment includes a motor current limit control which acts to remove operating voltage from said motor when a preset motor current limit corresponding to the pull force to be applied is reached;

c. the selected pull force is maintained after motor operating voltage is removed by the inherent friction of the gear reduction and drive screw;

d. the selected pull force is removed by running the motor briefly in the direction to back off the pull load and provide a running start when the next pull force is applied.

The foregoing disclosure and the showings made in the drawings are merely illustrative of the principles of this invention and are not to be interpreted in a limiting sense.

What is clamed is:

1. A wireline borehole shifting tool comprising:

a. an elongated tool body;

b. upper dog means connected to said body and adapted for engaging in the upward direction when extended, either a device to be shifted in a direction axially of said tool, or a member fixed relative to said device;

c. upper reciprocator shaft means connected to said upper dog means and adapted for connection to the wireline by which said tool may be suspended in said borehole;

i. said upper reciprocator shaft means being movable downwardly by the force of gravity to extend said upper dog means when said tool body is held against downward movement in said borehole and said wireline is slack;

ii. said upper reciprocator shaft means being movable upwardly to retract said upper dog means by application of tension to said wireline;

d. lower reciprocator shaft means disposed within said tool body below said upper dog means;

e. power means carried by said tool body connected to said lower reciprocator shaft means;

f. lower dog means adapted for engaging in the downward direction when extended, either said device to be shifted, or a member fixed relative to said device;

i. said lower dog means being connected to said lower reciprocator shaft means so that downward movement of said shaft means when said dogs are engaged will cause said lower dog means to move further away relative to said upper dog means, thus causing movement of said device to be shifted;

ii. bias means urging said lower dog means toward their extended position but permitting their movement toward the retracted position when they encounter forces acting in the radially inward direction; said shifting tool being thus adapted for shifting by virtue of force developed by said power means carried by said tool body with none of said force being applied, either upwardly or downwardly, to said wireline by which said tool may be suspended or traversed in said borehole; and said shifting tool being thus also adapted in the event of a power malfunction to be readily removed from said borehole by simply applying tension on said wireline and traversing said shifting tool upwardly out of said borehole.

2. The apparatus of claim 1 wherein said power means is disposed below said lower reciprocator shaft means.

3. The apparatus of claim 2 wherein said power means comprises an electric motor.

4. The apparatus of claim 3 wherein said power means comprises a drive screw driven by said electric motor through a gear reduction, with the drive screw engaging a reciprocable drive sleeve which is in turn connected to said reciprocator shaft means.

5. The apparatus of claim 1 wherein:

a. said upper dog means comprises a set of upper links and a set of lower links, with each upper link pivotally connected at its upper end to said upper reciprocator shaft means and pivotally connected at its lower end to a said lower link, and with said respective lower link pivotally connected at its lower end to said tool body and having an upwardly facing work engaging portion at its upper end; and, b. said lower dog means comprises a set of upper inks and a set of lower links, with each upper link pivotally connected at its upper end to said lower reciprocator shaft means and pivotally connected intermediate its ends with the upper end of a respective said lower link, with the lower end of each said lower link being pivotally connected to said bias means, and with the lower end of each said upper link protruding beyond the pivoting connection of said respective links and having a downwardly facing work engaging portion at its lower end.

6. The apparatus of claim 5 wherein said bias means comprises a slidable collar disposed on said lower reciprocator shaft means and urged in the upward direction by a compression spring carried by said lower reciprocator shaft means.

7. The apparatus of claim 5 wherein each lower link of said lower dog means is tapered so as to provide added clearance between its radially inwardly facing surface and said lower reciprocator shaft means.

8. The apparatus of clam 1 wherein said shifting tool includes caliper means for generating electrical signals which are a function of the diameter profile of the conduit that may be traversed by said tool.

9. The apparatus of claim 8 wherein said lower dog means is utilized as a sensor means for said caliper means.

10. The method of shifting a device in a well bore conduit comprising:

a. running into said conduit on a wireline a shifting tool with caliper means to a depth in the conduit below the device to be shifted;

b. activating the caliper means and traversing the tool upwardly past said device to make a log observable above ground of the diameter profile of the conduit portion traversed;

c. deactivating the caliper means and traversing the tool downwardly to a depth below the device;

d. activating the caliper means and traversing the tool upwardly while observing said conduit diameter profile previously made and comparing it with the conduit diameter profile log being made and then stopping the tool at a predetermined location relative to said device as determined by said profile comparison so as to properly position device engaging means;

e. energizing said tool and shifting said device;

f. disengaging said device engaging means, and withdrawing said tool from said well bore conduit.

11. The method of shifting a sleeve valve that is incorporated in a well bore conduit comprising:

a. running into said conduit on a wireline a shifting tool with caliper means to a depth in the conduit below the sleeve valve;

b. activating the caliper means and traversing the tool upwardly past said sleeve valve to make a log observable above ground of the diameter profile of the conduit portion traversed;

c. deactivating the caliper means and traversing the tool downwardly to a depth below the sleeve valve;

d. activating the caliper means Aand traversing the tool upwardly while observing said conduit diameter profile previously made and comparing it with the conduit diameter profile log being made and then stopping the tool at a predetermined location relative to said sleeve valve as determined by said profile comparison so as to properly position sleeve valve engaging means;

e. energizing said tool and shifting said sleeve valve;

f. disengaging said sleeve valve engaging means, and withdrawing said tool from said well bore conduit.

12. The method of shifting a device in a well bore conduit comprising:

a. running into said conduit on a wireline a shifting tool with caliper means to a depth in the conduit below the device to be shifted; with said shifting tool comprising:

i. an elongated tool body;

ii. upper dog means connected to said body and adapted for engaging n the upward direction when extended, either a device to be shifted in a direction axially of said tool, or a member fixed relative to said device;

iii. upper reciprocator shaft means connected to said upper dog means and adapted for connection to the wireline by which said tool may be suspended in said borehole;

aa. said upper reciprocator shaft means being movable downwardly by the force of gravity to extend said upper dog means when said tool body is held against downward movement in said borehole and said wireline is slack;

bb. said upper reciprocator shaft means being movable upwardly to retract said upper dog means by application of tension to said wireline;

iv. lower reciprocator shaft means disposed within said tool body below said upper dog means;

v. power means carried by said tool body connected to said lower reciprocator shaft means;

vi. lower dog means adapted for engaging in the downward direction when extended, either said device to be shifted, or a member fixed relative to said device;

aa. said lower dog means being connected to said lower reciprocator shaft means so that downward movement of said shaft means when said dogs are engaged will cause said lower dog means to move further away relative to said upper dog means, thus causing movement of said device to be shifted;

bb. bias means urging said lower dog means toward their extended position but permitting their movement toward the retracted position when they encounter forces acting in the radially inward direction;

b. activating the caliper means and traversing the tool upwardly past said device to make a log observable above ground of the diameter profile of the conduit portion traversed;

c. deactivating the caliper means and traversing the tool downwardly to a depth below the device;

d. activating the caliper means and traversing the tool upwardly while observing said conduit diameter profile previously made and comparing it with the conduit diameter profile long being made and then stopping the tool at a predetermined location relative to said device as determined by said profile comparison so as to properly position said lower dog means;

e. removing tension from said wireline so as to extend said upper dog means;

f. energizing said power means and shifting said device;

g. energizing said power means to retract said lower dog means;

h. applying tension to said wireline to retract said upper dog means and withdrawn said tool from said well bore conduit.

13. The method of claim 12 wherein the device to be shifted is a sleeve valve; said power means comprises an electric motor and is disposed below said lower reciprocator shaft means; said caliper means is incorporated in said shifting tool and said lower dog means is utilized as a sensor means for said caliper means.

14. The method of claim 13 wherein:

a. said upper dog means comprises a set of upper links and a set of lower links, with each upper link pivotally connected at its upper end to said upper reciprocator shaft means and pivotally connected at its lower end to a said lower link, and with said respective lower link pivotally connected at its lower end to said tool body and having an upwardly facing work engaging portion at its upper end; and, b. said lower dog means comprises a set of upper links and a set of lower links, with each upper link pivotally connected at its upper end to said lower reciprocator shaft means and pivotally connected intermediate its ends with the upper end of a respective said lower link, with the lower end of each said lower link being pivotally connected to said bias means, and with the lower end of each said upper link protruding beyond the pivoting connection of said respctive links and having a downwardly facing work engaging portion at its lower end.

15. The method of shifting a device in a wellbore conduit, which device is subject to difficulty in initiating its shifting movement, said method comprising:

a. applying a first shifting force to said device to be shifted, which first shifting force is at least as great as that which would normally be required to initiate shifting movement of said device and maintaining said first force for a short time period and then removing it;

b. then applying a second shifting force to said device which second shifting force is greater than the first shifting force and maintaining said second force for a short time period and then removing it;

c. then, if movement is not initiated, applying a third shifting force greater than the second and maintaining it for a short period of time and then removing it;

d. then, if movement is not initiated, applying, maintaining, and removing additional shifting forces until either movement is initiated or the shifting tool maximum force capacity is reached;

e. said shifting forces being applied by an electrical motor incorporated in a shifting tool and powering a reciprocable drive shaft through a gear reduction and a drive screw;

f. with above ground equipment including a motor current limit control which acts to remove operating voltage from said motor when a preset motor current limit corresponding to the shifting force to be applied is reached;

g. with the selected shifting force being maintained after motor operation voltage is removed by the inherent friction of the said gear reduction and drive screw; and h. with the selected shifting force being removed by running said motor briefly in the direction to back off the shifting force load and provide a running start when the next shifting force is applied.

* * * * *